US005588730A

United States Patent [19]

Röck et al.

[11] Patent Number: 5,588,730

[45] Date of Patent: Dec. 31, 1996

[54] FITTING

[75] Inventors: Erich Röck, Höchst; Edgar Huber, Hard, both of Austria

[73] Assignee: Julius Blum Gesellschaft m.b.H., Höchst, Austria

[21] Appl. No.: 372,328

[22] Filed: Jan. 13, 1995

[30] Foreign Application Priority Data

Jan. 17, 1994 [AT] Austria ..... A 77/94

[51] Int. Cl.[6] ..... A47B 88/00

[52] U.S. Cl. ..... 312/348.2; 312/263

[58] Field of Search ..... 312/348.1, 348.2, 312/348.4, 330.1, 263, 265.5, 265.6; 403/231, 403, 382, 205

[56] References Cited

U.S. PATENT DOCUMENTS

| | | | |
|---|---|---|---|
| 1,648,591 | 11/1927 | Repay | 403/407.1 X |
| 2,620,248 | 12/1952 | Mutchnik | 403/407.1 X |
| 3,901,572 | 8/1975 | Litchfield | 312/263 X |
| 3,980,364 | 9/1976 | Entrikin et al. . | |
| 4,025,138 | 5/1977 | Kittle . | |
| 4,199,200 | 4/1980 | Livingston et al. . | |
| 4,303,289 | 12/1981 | Hardy | 312/348.2 |
| 4,627,760 | 12/1986 | Yagi et al. . | |
| 4,671,581 | 6/1987 | Faust et al. | 312/330.1 |
| 4,840,512 | 6/1989 | Rock et al. | 312/330.1 X |
| 4,911,509 | 3/1990 | Rock et al. | 312/348.1 |

FOREIGN PATENT DOCUMENTS

| | | | |
|---|---|---|---|
| 12030 | 6/1980 | European Pat. Off. | 312/348.2 |
| 470725 | 2/1992 | European Pat. Off. | 312/330.1 |
| 551575 | 7/1993 | European Pat. Off. | 312/348.2 |
| 2844850 | 4/1980 | Germany . | |
| 2904116 | 8/1980 | Germany . | |
| 3335700 | 4/1985 | Germany . | |
| 9115465.0 | 4/1992 | Germany . | |
| 639252 | 11/1983 | Switzerland | 312/330.1 |
| 660633 | 11/1951 | United Kingdom . | |

*Primary Examiner*—Peter M. Cuomo
*Assistant Examiner*—Janet M. Wilkens
*Attorney, Agent, or Firm*—Wenderoth, Lind & Ponack

[57] ABSTRACT

A fitting for fixing a rear wall of a drawer to a side part of the drawer includes a supporting part which can be fixed to the drawer side part and has fixing lugs which engage in receiving openings in a holding part. The holding part can be fixed on the rear wall of the drawer.

14 Claims, 7 Drawing Sheets

FITTING

BACKGROUND OF THE INVENTION

The invention relates to a fitting for fixing a rear wall of a drawer on a side part of the drawer such as a drawer side or runner of the drawer side, and including a supporting part which can be fixed on the side part of the drawer and having fixing lugs which engage in receiving openings in a corresponding holding part on each said or end of the rear drawer rear wall.

In modern furniture construction drawers are known which are made entirely by injection molding of plastics material, but drawers are also known in which the sides are produced from plastics material or a metal and which are connected to a rear wall is likewise prefabricated from plastics material or prefabricated from a metal. In many cases, particularly in smaller production runs, it is advantageous for the furniture manufacturer if, as far as the width of the drawer is concerned, he is not dependent upon prefabricated parts. That is, it is advantageous to be able to produce drawers of any width without special expenditures.

The object of the invention is to create a fitting which enables a rear wall, which is in particular made from a wood material or also from extruded plastics materials or the like and has been cut to a specific length, to be connected by quick assembly to a drawer side or to be connected by quick assembly to an adapter connected to the drawer side or to a runner of the drawer.

SUMMARY OF THE INVENTION

The object according to the invention is achieved in that a supporting part can be coupled by means of fixing lugs to a holding part which can be fixed, preferably screwed, on the rear wall. Each holding part has a fixing flange which is aligned parallel with rear wall and by which it can be fixed on the rear wall, and a housing portion in a side wall of which are located holes in which the fixing lugs engage.

By means of the fitting according to the invention it is possible for a rear wall, which has been produced so to speak as piece goods and has been produced from a cut panel of chipboard or, as already mentioned, as an extruded part made from plastics material or aluminum, to be incorporated into a modular system of a drawer to be produced from prefabricated parts.

DETAILED DESCRIPTION OF THE INVENTION

Figure 1:
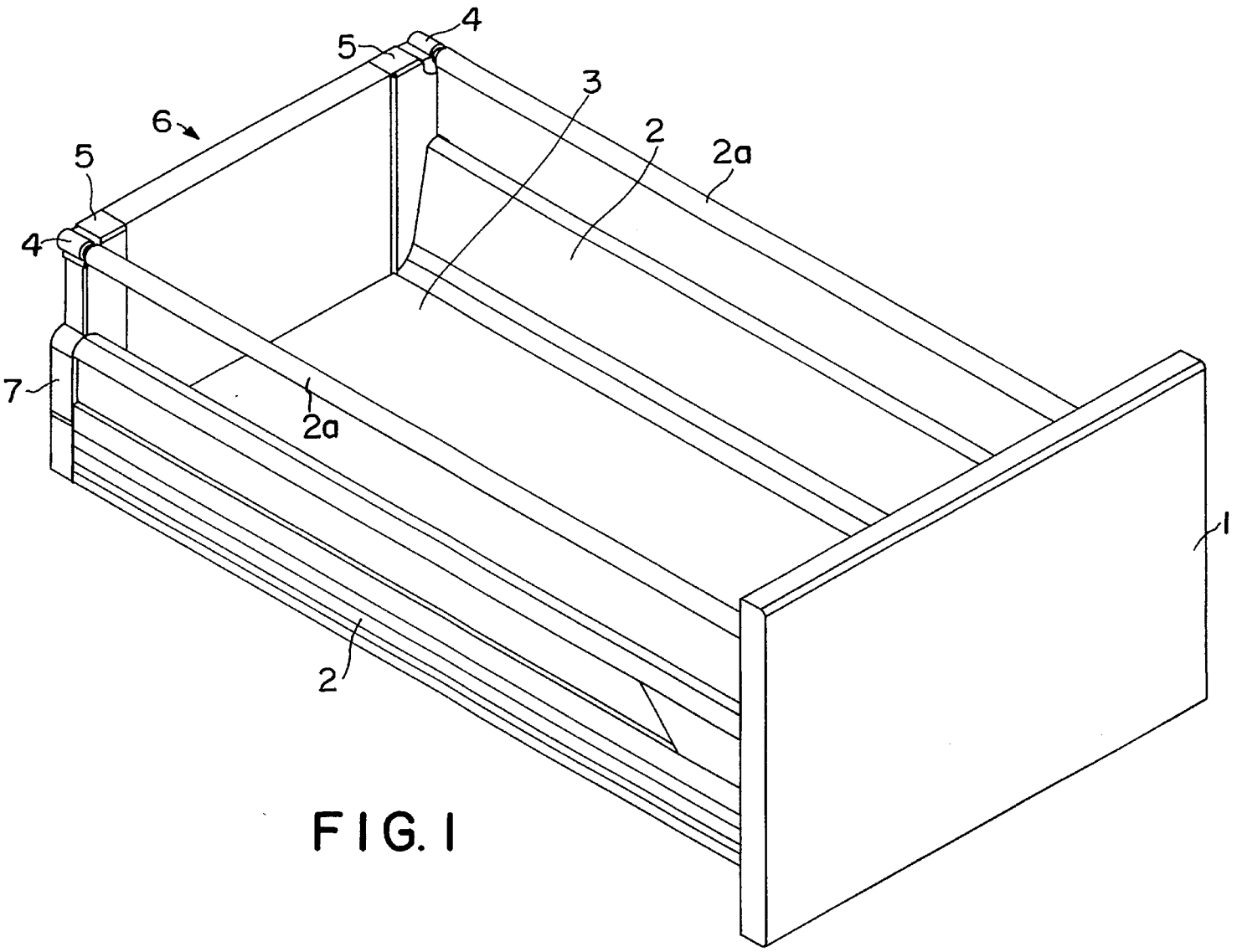
FIG. 1 is a perspective view of a drawer.
Figure 2:
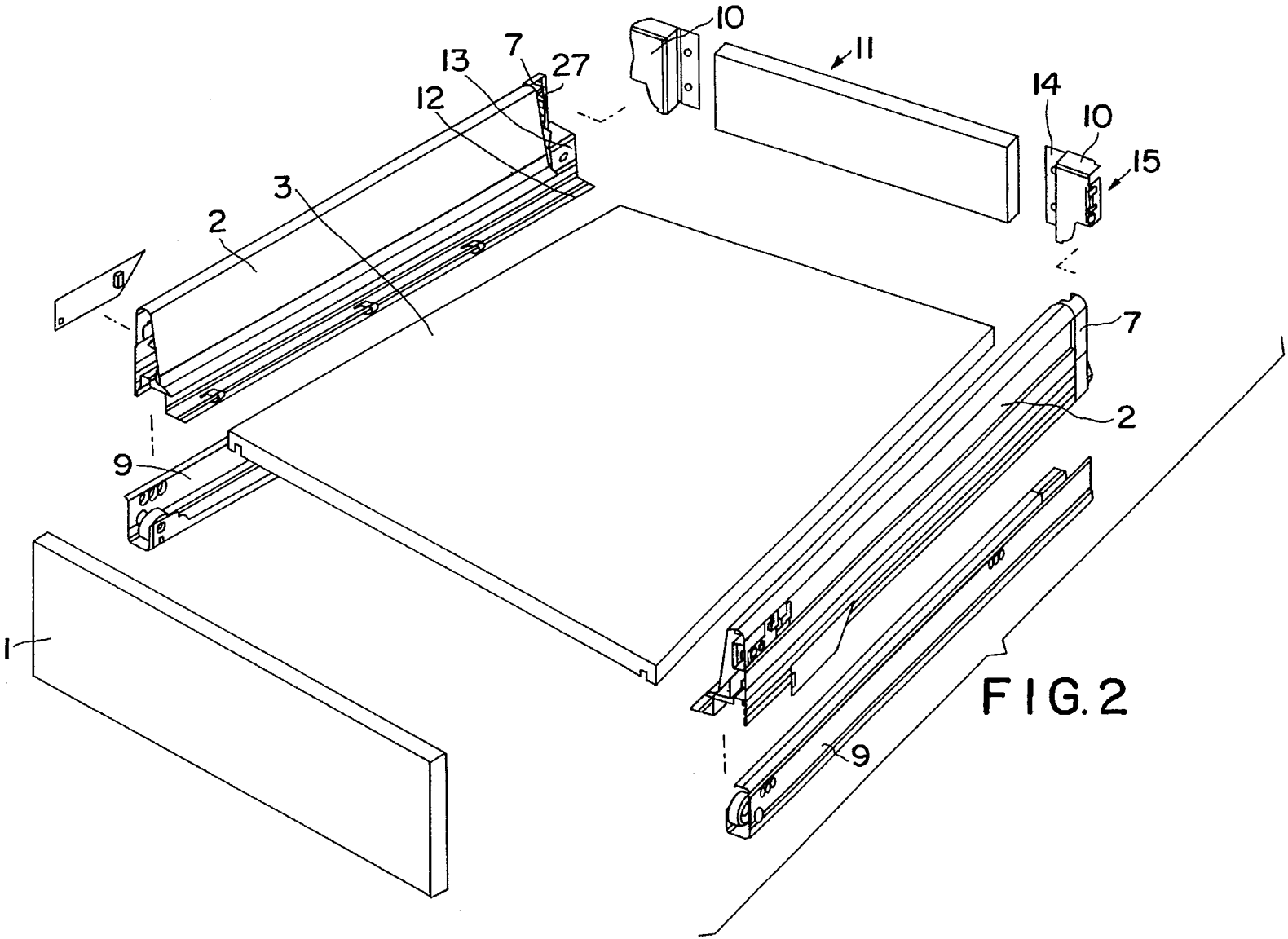
FIG. 2 is an exploded perspective view of a further embodiment of a drawer.
Figure 3:
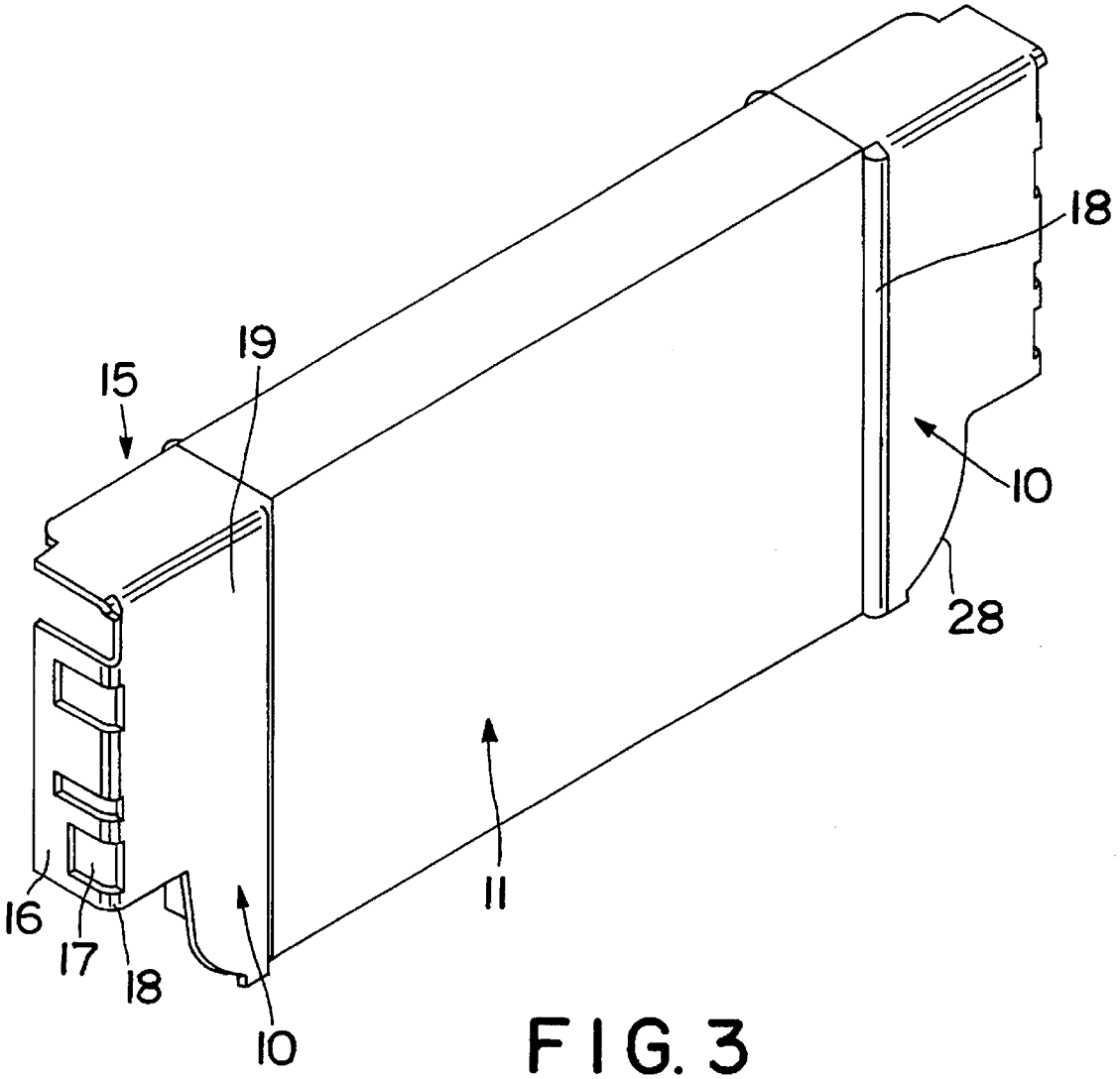
FIGS. 3 and 4 are perspective views of rear walls.
Figure 4:
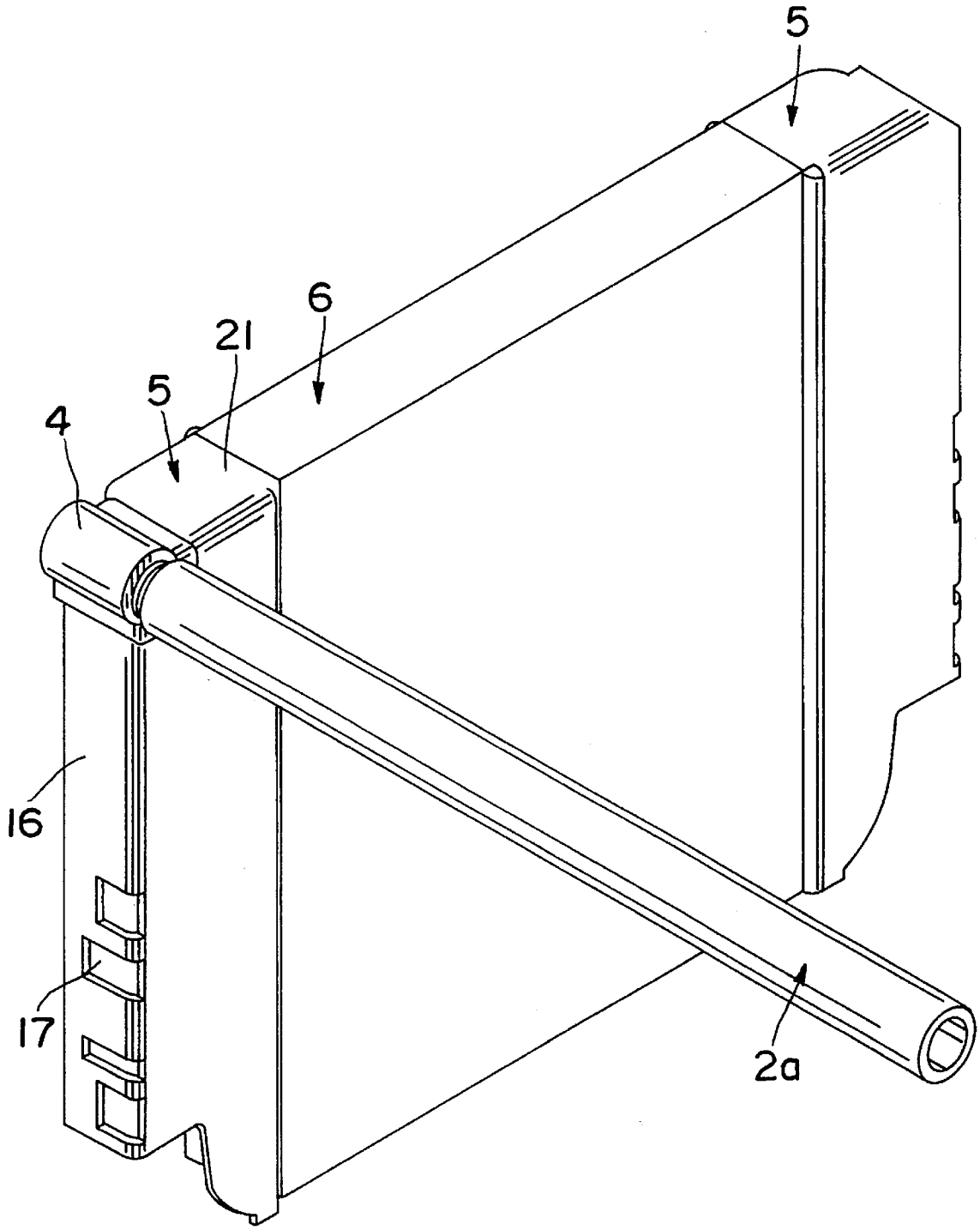
Figure 5:
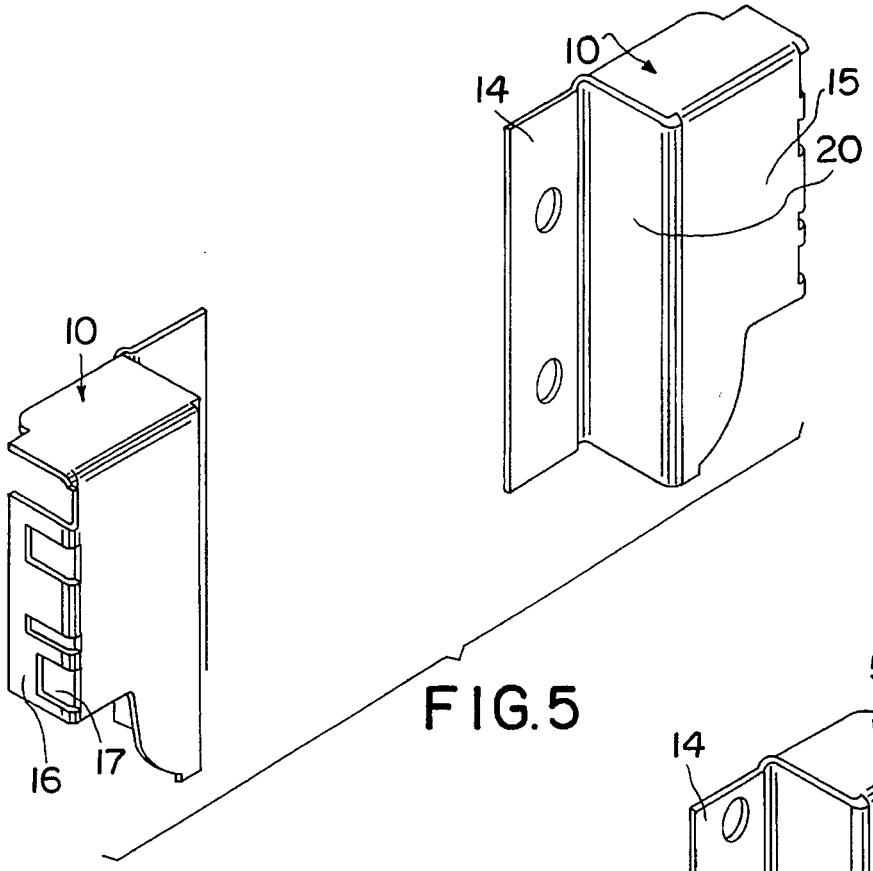
FIGS. 5 and 6 are perspective views of two different embodiments of pairs holding parts.
Figure 6:
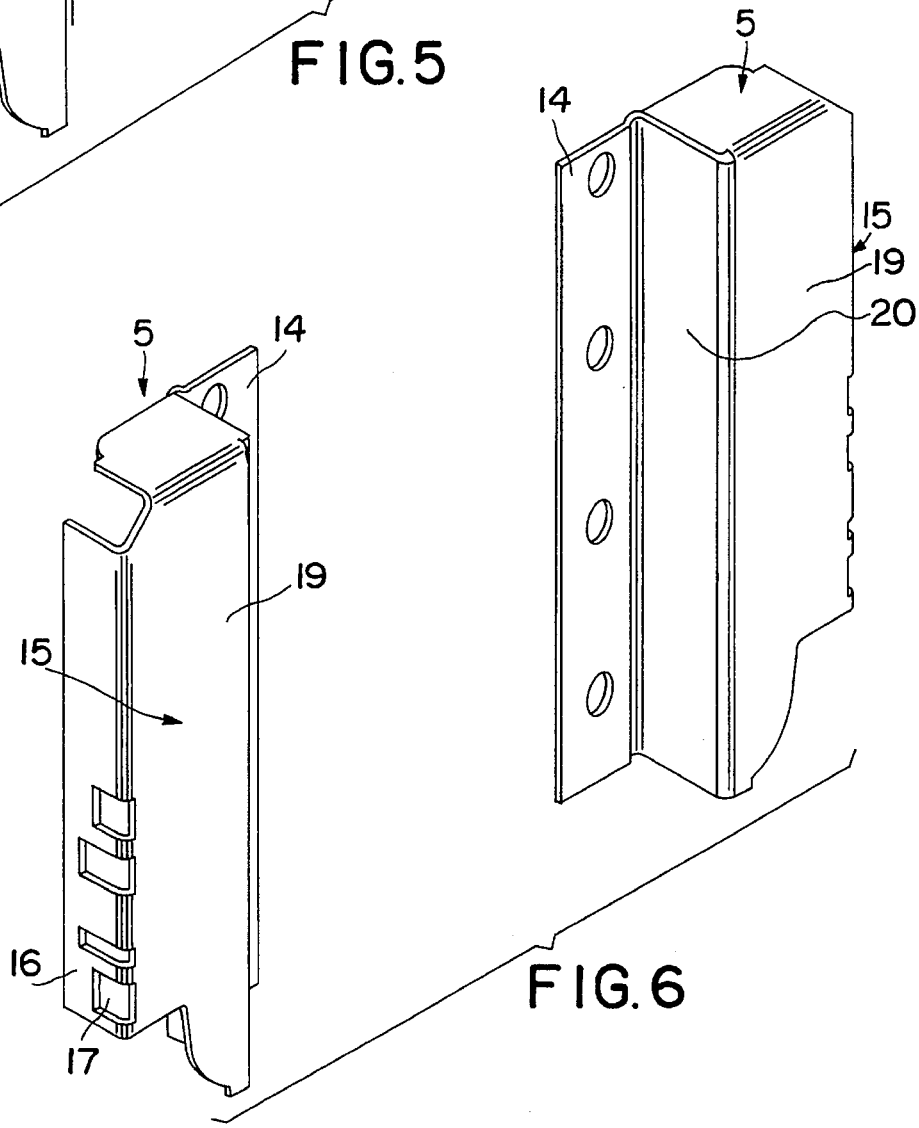
Figure 8:
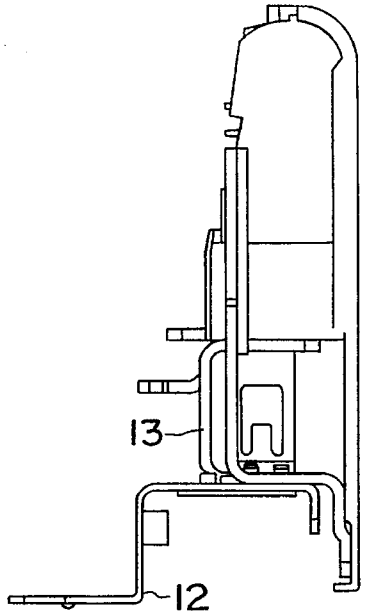
FIG. 8 is an end view of the supporting part.
Figure 7:
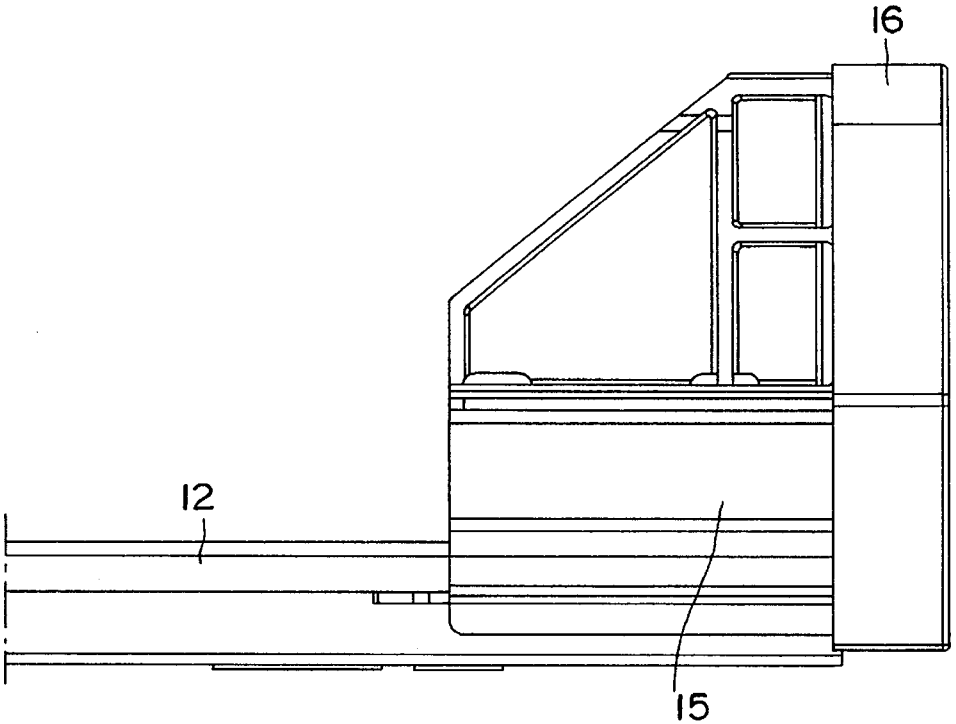
FIG. 7 is a side view of a supporting part.
Figure 9:
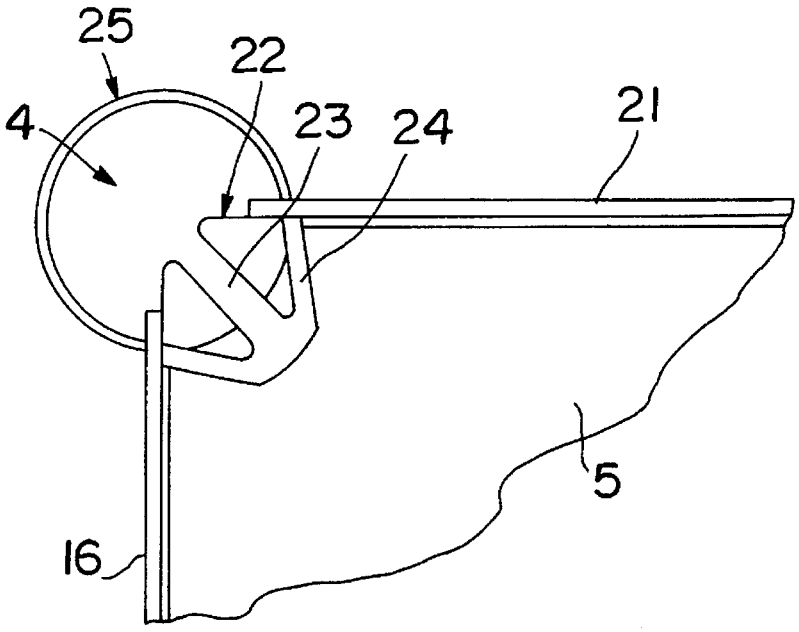
FIG. 9 shows an end view of a rail mounting.
Figure 10:
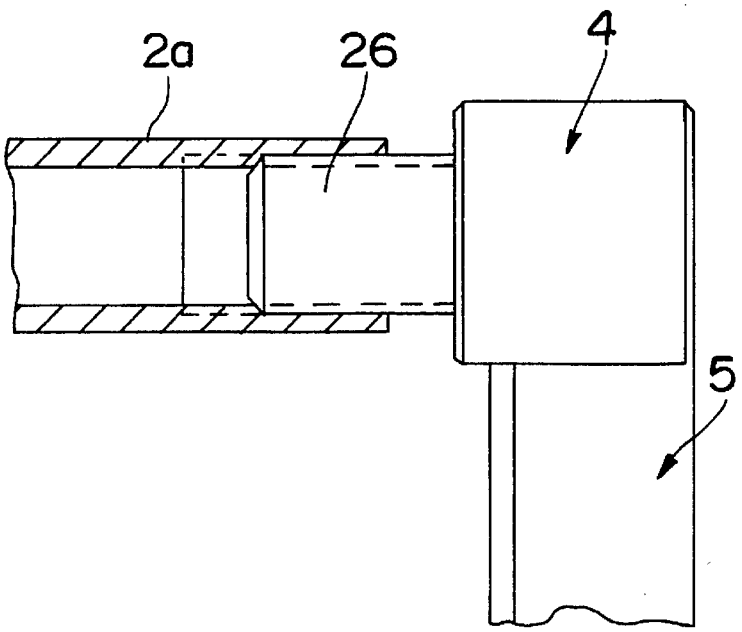
FIG. 10 is a partial sectional side view of the rail mounting on the rear wall.

As can be seen from FIGS. 1 and 2, a drawer has in the usual way two drawer sides 2, a front panel 1, a drawer base 3 and a rear wall 6 or 11. The front panel 1 is connected in the usual way to the drawer sides 2 or to runners 12 which are set into the drawer sides 2. The runners 12, which run on supporting rails 9 fixed on the side walls of a furniture body, are provided on their rear ends with respective adapters 13. The adapters are for example welded to the runners 12.

The adapter 13 in turn supports a supporting part 7, which is produced for example from plastics material or another injectable material and is screwed, riveted or pushed onto the adapter 13. The supporting parts 7 have fixing lugs 27 which are directed towards the interior of the drawer and are of resilient and preferably hook-shaped construction. In this case the fixing lugs 27 point towards a central plane of the drawer which is aligned perpendicular to the rear wall 6, 11 and perpendicular to the drawer base 3.

The rear walls 6, 11 are both produced from a chipboard material and have been cut to a desired length from a longer board. Before the drawer is assembled, each rear wall 6, 11 is screwed at opposite ends thereof to fixing flanges 14 of holding parts 5 or 10. In the illustrated embodiment the fixing flanges 14 rest against the back surface of the rear wall 6, 11. The holding parts 10 are the same height as the drawer side 2, while the holding parts 5 project above the drawer sides 2 and serve for fixing drawer rails 2*a*.

Each holding part 5, 10 has a housing like portion 15 with a side wall 16. In the side wall 16 are located fixing holes 17 which in the illustrated embodiment are disposed in the region of an edge 18 between the side wall 16 and a closure wall 19 of the housing portion 15. Closure wall 19 is aligned parallel with the rear wall 6, 11. Flange 14 and closure wall 19 are connected by a member 20, e.g. a connecting wall that extends parallel to side wall 16. Thus, walls 16 and 19 and member 20 define housing portion 15 that is open towards the rear but on the face of the rear wall 6, 11 inside the drawer wall 19 closes off or continue the inner closure surface of the rear wall 6, 11. Furthermore, the housing portions 15 are each provided at the bottom thereof with a cut-out 28 which receives the adapter 13 and the runner 12 when the holding parts 5, 10 are installed.

A clip 4 which holds a rail 2*a* can be inserted into the respective holding part 5. Each holding part 5 has an upper closure wall 21 which projects horizontally towards the rear and a side wall 16 which is of equal width and is directed towards the rear. A slot 22 is located between the walls 16, 21 in the outer upper corner of the holding part 5. The clip 4 is pushed into the slot 22. The clip 4 has a central web or bar 23 and two holding arms 24 spreading in a V shape as well as a cylindrical body portion or segment 25 with a base surface of 270°. Portion 25 has removed therefrom a cut-out in the form of a segment with an arc of 90°. Central web or bar 23 is integral with body portion 25 and extends therefrom through the cut-out.

The clip 4 is pushed onto the corner of the holding part 5 in such a way that the central web 23 protrudes through the slot 22 and the holding arms 24 are supporting on the inner faces of the walls 16, 21. The cylindrical portion 25 of the clips 4 rests on the outside of the walls 16, 21. In the illustrated embodiment there is disposed on the clip 4 a lug 26 onto which the rail 2*a* is screwed and which directly supports the rail 2*a*.

We claim:

1. A fitting for use in attaching a rear wall of a drawer to a side part of the drawer, said fitting comprising:

a holding part including a flange to extend in a direction to be parallel to a rear surface of the rear wall and to be attached thereto, and a housing portion integral with said flange and extending laterally therefrom in a direction such that when said flange is attached to the rear surface of the rear wall said housing portion is positioned at a location of a respective lateral end of the rear wall to form a lateral extension thereof;

said housing portion including a closure wall extending parallel to said flange in a direction to form a closed lateral continuation of a front surface of the rear wall, a member connecting said flange to one lateral end of said closure wall, a side wall integral with an opposite lateral end of said closure wall and defining therewith a corner, said side wall extending perpendicular to said closure wall in a direction to be rearward of the drawer, and locating holes formed in said side wall; and a supporting part to be attached to the side part of the drawer, said supporting part having extending laterally therefrom fixing lugs to engage in said locating holes to thereby attach said holding part to said supporting part with said housing portion positioned laterally between the side part and the rear wall of the drawer.

2. A fitting as claimed in claim 1, wherein said connecting member comprises a connecting wall to abut the respective lateral end of the rear wall and to extend parallel to said side wall longitudinally of the drawer, and said flange and said closure wall extend in opposite lateral directions from opposite longitudinal ends of said connecting wall.

3. A fitting as claimed in claim 1, wherein said holding part is made from sheet steel, and said supporting part is made from plastic material.

4. A fitting as claimed in claim 1, wherein said locating holes are formed at least partially in the region of said corner.

5. A fitting as claimed in claim 1, wherein said holding part has a height to extend above the side part of the drawer, said housing portion has an upper outer corner having therein a horizontal slot, and further comprising a clip fitting into said slot and to support a rear end of a drawer rail.

6. A fitting as claimed in claim 5, wherein said clip comprises a body defining a cylindrical segment with an arc of 270° and having a cut-out in the form of a segment with an arc of 90°, a bar integral with said body and extending therefrom through said cut-out, and a pair of holding arms integral with said bar and defining a V-shape.

7. A fitting as claimed in claim 6, wherein said holding arms abut an inner surface of said side wall and an inner surface of an upper wall of said housing portion that extends perpendicular to said side wall.

8. A fitting member to be part of a fitting for use in attaching a rear wall of a drawer to a side part of the drawer, such fitting also including a supporting part to be attached to the side part of the drawer, said fitting member comprising a holding part to be connectable to the supporting part, said holding part including:

a flange to extend in a direction to be parallel to a rear surface of the rear wall and to be attached thereto;

a housing portion integral with said flange and extending laterally therefrom in a direction such that when said flange is attached to the rear surface of the rear wall said housing portion is positioned at a location of a respective lateral end of the rear wall to form a lateral extension thereof; and said housing portion including a closure wall extending parallel to said flange in a direction to form a closed lateral continuation of a front surface of the rear wall, a member connecting said flange to one lateral end of said closure wall, a side wall integral with an opposite lateral end of said closure wall and defining therewith a corner, said side wall extending perpendicular to said closure wall in a direction to be rearward of the drawer, and locating holes formed in said side wall.

9. A fitting member as claimed in claim 3, wherein said connecting member comprises a connecting wall to abut the respective lateral end of the rear wall and to extend parallel to said side wall longitudinally of the drawer, and said flange and said closure wall extend in opposite lateral directions from opposite longitudinal ends of said connecting wall.

10. A fitting member as claimed in claim 8, wherein said holding part is made from sheet steel.

11. A fitting member as claimed in claim 8, wherein said locating holes are formed at least partially in the region of said corner.

12. A fitting member as claimed in claim 8, wherein said holding part has a height to extend above the side part of the drawer, said housing portion has an upper, outer corner having therein a horizontal slot, and further comprising a clip fitting into said slot and to support a rear end of a drawer rail.

13. A fitting member as claimed in claim 8, wherein said clip comprises a body defining a cylindrical segment with an arc of 270° and having a cut-out in the form of a segment with an arc of 90°, a bar integral with said body and extending therefrom through said cut-out, and a pair of holding arms integral with said bar and defining a V-shape.

14. A fitting member as claimed in claim 13, wherein said holding,arms abut an inner surface of said side wall and an inner surface of an upper wall of said housing portion that extends perpendicular to said side wall.

* * * * *